United States Patent [19]

Kuwada

[11] Patent Number: 4,632,601

[45] Date of Patent: Dec. 30, 1986

[54] SYSTEM AND METHOD FOR DISPOSAL OF NONCONDENSABLE GASES FROM GEOTHERMAL WELLS

[76] Inventor: James T. Kuwada, 5601 Sierra Ave., Richmond, Calif. 94805

[21] Appl. No.: 794,201

[22] Filed: Nov. 1, 1985

[51] Int. Cl.[4] ..... G21F 9/24

[52] U.S. Cl. ..... 405/128; 405/53; 166/305.1

[58] Field of Search ..... 405/52, 53, 54, 55, 405/57, 128, 129; 166/265, 274, 275, 305.1, 309

[56] References Cited

U.S. PATENT DOCUMENTS

| | | | |
|---|---|---|---|
| 1,921,358 | 8/1933 | Hill et al. | 405/53 X |
| 2,261,100 | 10/1941 | Erwin | 405/128 X |
| 3,363,692 | 1/1968 | Bishop | 405/128 X |
| 3,393,738 | 7/1968 | Bernard et al. | 166/309 X |
| 3,706,630 | 12/1972 | Cohen et al. | 405/128 X |
| 3,889,764 | 6/1975 | Jackson | 166/309 X |
| 4,429,740 | 2/1984 | Malinchak | 405/128 X |
| 4,457,375 | 7/1984 | Cummins | 166/309 |

*Primary Examiner*—Richard J. Scanlan, Jr.
*Assistant Examiner*—Nancy J. Stodola
*Attorney, Agent, or Firm*—John L. McGannon

[57] ABSTRACT

A system and process for dissolving certain noncondensable gases into geothermal waste water after the useful energy has been extracted from the geothermal fluid from which the noncondensable gases and the waste water are derived. A tubing is mounted in place within a wellhead casing which extends downwardly therefrom to an injection zone below ground. The length of the tubing is selected to at least correspond to the depth in the casing which provides a static waste water head pressure equal to the gas partial pressure required to dissolve at least a portion of the noncondensable gases into the waste water. The tubing has holes near the lower open end which communicates with the wellhead casing so that the noncondensable gases can flow into the wellhead casing and dissolve in the waste water flowing downwardly in the casing to the injection zone. A gas cap chamber is provided near the upper end of the wellhead casing for collecting the noncondensable gases which are undissolved and rise to the wellhead. These accumulated gases can be vented to the atmosphere because they will be essentially free of hydrogen sulfide, which will have been preferentially absorbed into the waste water in the gas injection zone of the well bore.

22 Claims, 1 Drawing Figure

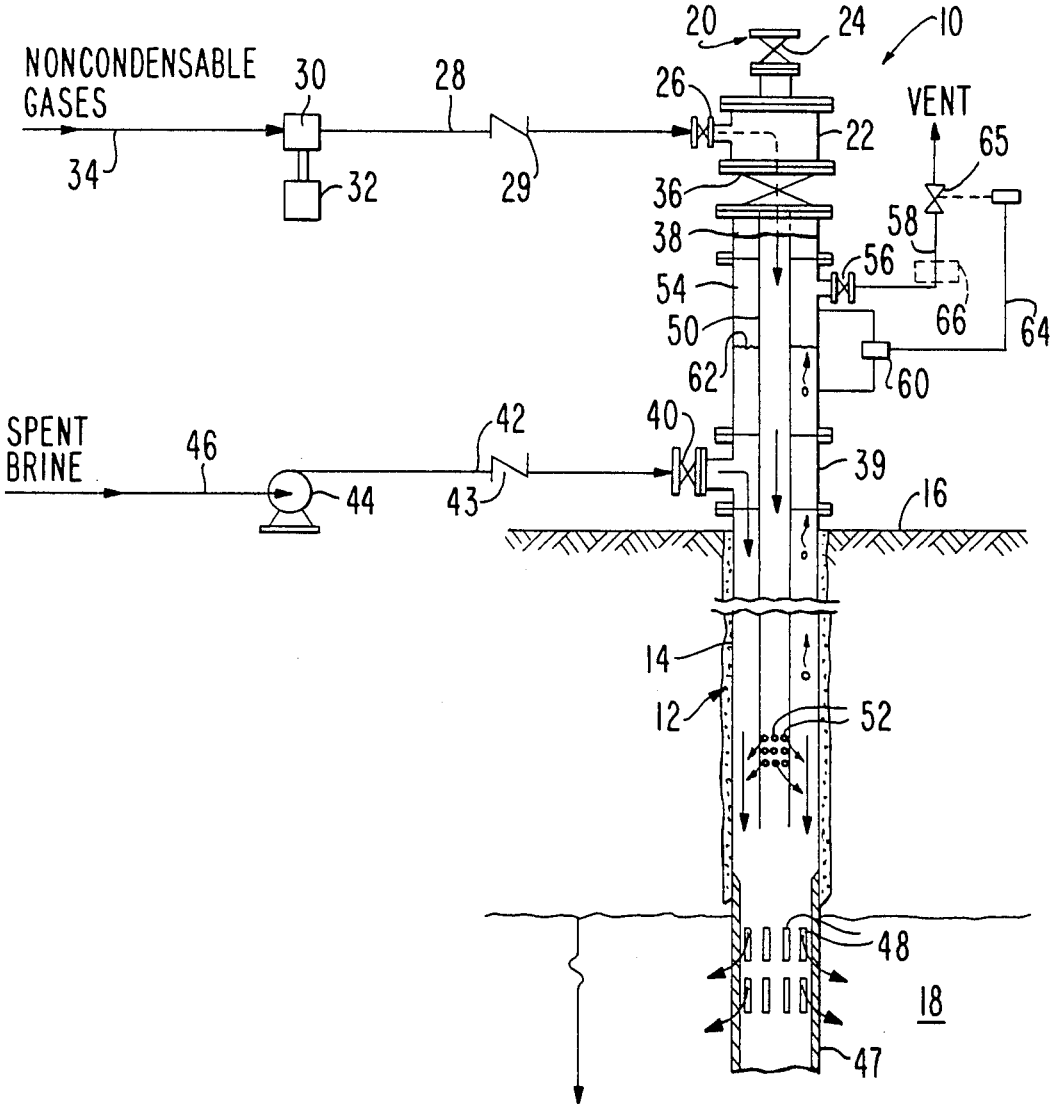
NONCONDENSABLE GASES
SPENT BRINE
VENT
10
12
14
16
18
20
22
24
26
28
29
30
32
34
36
38
39
40
42
43
44
46
47
48
50
52
54
56
58
60
62
64
65
66

SYSTEM AND METHOD FOR DISPOSAL OF NONCONDENSABLE GASES FROM GEOTHERMAL WELLS

This invention relates to the handling of geothermal fluids and, more particularly to a system and process for returning noncondensable geothermal gases, such as hydrogen sulfide gas, to a geothermal well reservoir.

BACKGROUND OF THE INVENTION

Geothermal wells may produce dry steam from vapor-dominated reservoirs or a mixture of steam and hot water (brine) from liquid-dominated reservoirs in which the hot brine flashes partly to steam as the brine flows upwardly from the well through a well bore. The steam produced by both types of geothermal resources contain noncondensable gases herein defined as carbon dioxide gas with varying amounts of other constituents, such as methane, nitrogen, hydrogen, argon, ammonia and hydrogen sulfide, which are not condensable at ambient conditions, i.e., which do not condense at the operating pressures and temperatures of geothermal power plants.

Geothermal energy is made available to the marketplace by converting it to electricity. To accomplish this, geothermal steam is fed to a steam turbine that drives an electric generator. Exhaust steam from the turbine may be discharged directly to the atmosphere or, for greater thermal efficiency, the steam may be condensed to reduce the pressure at the exhaust outlet of the turbine. The noncondensable gases that accumulate in the condenser are extracted and vented to the atmosphere.

If the turbine is located in an environmentally sensitive area, or if the geothermal steam contains a high concentration of hydrogen sulfide gas, it may be required that the hydrogen sulfide gas be first removed from the noncondensable gases before the gases are discharged to the atmosphere. The reason for this is that hydrogen sulfide gas is toxic at high concentrations. Even at low concentrations, hydrogen sulfide gas presents a problem, mainly aesthetic, because the hydrogen sulfide gas imparts a "rotten egg" smell that can be detected by the sensitive human nose at concentrations as low as 0.5 parts per million.

The Stretford process has often been used to treat noncondensable gases before they are discharged to the atmosphere. The Stretford process uses a vanadium catalyst to convert the hydrogen sulfide gas to elemental sulfur, thereby removing hydrogen sulfide gas from the noncondensable gases. The Stretford process is effective in removing the hydrogen sulfide gas, but the processing unit needed to carry out the Stretford process is relatively expensive and is costly to install, and the elemental sulfur product that is recovered is often contaminated and must be discarded as waste material.

The Dow Chemical Company has developed a process in which hydrogen sulfide gas is incinerated and converted into a water soluble thiosulfate. This liquid material is then disposed of by injecting the wastes through a well into the reservoir from which the geothermal fluid was produced. The Dow process is claimed to be less expensive than the Stretford process, and it does not produce solid waste material that requires special handling and disposal because of the contaminants. However, reactive thiosulfate may break down in the hot environment of the reservoir and form sulfates which may react with the calcium and magnesium values contained in the rock matrix of the reservoir. Such reactions will form precipitates that may plug or reduce the permeability of the waste water injection zone.

SUMMARY OF THE INVENTION

The present invention is directed to a system and process by which noncondensable gases from geothermal wells, including hydrogen sulfide gas, is safely disposed of by injecting the noncondensable gases into a waste water disposal well. However, to prevent "gas binding" and unstable operation of the waste water injection system, the noncondensable gases containing the hydrogen sulfide gas must be dissolved in the waste water. It may not be possible to accomplish this by simply injecting the noncondensable gases into the surface pipeline connected to the injection wellhead because the pressure required to dissolve the gases into the waste water may be much higher than the pressure required to inject the waste water into the injection well itself. The reason for this is because the injection pressure is determined primarily by the permeability of the reservoir in the injection zone below ground level. If the reservoir formation is highly permeable, then the static head of the cooled waste water (spent brine) may be all that is required to inject it into the injection zone. This is especially true where the static water level in the injection well is 100 or more feet below ground level.

The pressure required to dissolve the noncondensable gases into the waste water, on the other hand, is determined by Henry's Law of Gas Solubility. This pressure may be hundreds of pounds of pressure greater than the pressure required for injecting waste water into the injection zone below ground level. Thus, if the line to the injection wellhead is maintained by a back pressure control valve at a pressure sufficient to dissolve the gases into the waste water, the gases will begin to exsolve or go out of solution when the waste water enters the wellhead which is operating at a lower pressure. The exsolved gases will tend to coalesce into large bubbles that will act to "gas bind" the injection well. Subsequent collapse of the gas bubbles may cause water hammer and pressure surges which, at the least, will unstabilize operations and, at the worst, may damage the well or injection pump, especially after repeated cycles of bubble formation and cavitation.

The present invention avoids the above problems by injecting the noncondensable gases through a separate tubing that is mounted within the injection well bore leading to the injection well below ground level. The minimum length of the gas injection tubing is selected to correspond to the depth in the well which provides a static head pressure equal to the gas partial pressure required to dissolve the noncondensable gases into the waste water. The required gas partial pressure can be determined from Henry's Law which is given as follows:

$$P = K_H \cdot (X)$$

where P is the partial pressure, $K_H$ is the Henry's Law constant and X is the mole fraction of the gas to be dissolved in the waste water. The values of $K_H$ in bars per mole fraction at 100° C. for several noncondensable gases are as follows: carbon dioxide—5245, hydrogen sulfide—1555, and ammonia—14.5. Other values of $K_H$ can be obtained from chemical reference books.

Because the noncondensable gases are a mixture of gases, the required pressure for gas injection will be the sum of the partial pressures of the gases comprising the mixture. If the waste water to be disposed of by injection is hot, the saturation pressure corresponding to the temperature of the waste water must be added to the sum of the gas partial pressures to arrive at the total pressure required for gas injection.

The solubility of carbon dioxide, hydrogen sulfide and ammonia is high in comparison to that of methane, nitrogen, hydrogen and argon. Thus, if the latter four constituents are present in the noncondensable gases in significant amounts, the total pressure required to dissolve all the gas constituents may be very high. In such cases, the gas injection pressure may be set at the sum of the partial pressures of the more soluble constituents, for example, carbon dioxide, hydrogen sulfide and ammonia. The undissolved bubbles of methane, nitrogen, hydrogen and argon will, in part, be swept down with the waste water that is flowing down the well bore at a typical rate of 4 to 8 feet per second.

The bubbles which manage to rise to the top of the wellhead will accumulate in the gas chamber provided above the brine inlet nozzle. The gas space is provided to collect the gas and not interfere with the entering brine flow. A gas-liquid interface level controller can be used to maintain the gas level above the brine inlet nozzle to prevent gas entrapment in the brine and "gas binding." The level controller will operate to vent the excess gas which is free of hydrogen sulfide because the hydrogen sulfide gas will have been absorbed into the waste water (brine), deep in the well bore at the point of gas injection.

Certain advantages accrue from the practice of the present invention which are not available with the practice of existing methods for the safe disposal of hydrogen sulfide gas contained in the noncondensable gases from geothermal fluids. These advantages are as follows:

(1) The noncondensable gases are returned to the reservoir formation in the same chemical form in which they were produced.

(2) The noncondensable gases are not required to be subjected to sophisticated chemical processing that creates waste products requiring special handling and disposal because the wastes are contaminated with toxic substances, e.g., arsenic, boron, fluorides, etc. Moreover, hydrogen sulfide is not converted to a form that may decompose in the reservoir and precipitate solids that could plug or impair the permeability of the injection zone.

(3)Because the noncondensable gases are injected into the waste water (brine) through a separate tubing string set inside a well bore, waste water only need be pumped to the pressure required to inject and dispose of the waste water in the well bore itself. In many situations, it is only necessary to deliver the waste water to the injection wellhead because the static head of the cooled waste water is sufficient to dispose of the fluid down the well bore.

(4) By injecting the noncondensable gases through a separate tubing down to a depth of hydraulic head pressure corresponding to the partial pressure required to dissolve the gases into the solution, the overall injection system pressure will be stable. The noncondensable gases discharged through a series of small orifices in the tubing wall will be tiny, compressed bubbles because of the high pressure at the point of gas injection into the waste water. These small gas bubbles will facilitate dissolution of the noncondensable gases into the waste water.

(5) Because the gas injection pressure is determined by the sum of the gas partial pressures of the constituents to be absorbed in the waste water, it is possible to control the gas injection pressure and the gas constituents to be absorbed. The present invention will permit selective absorption of the soluble gases from the less soluble gases. Any of the less soluble gases that rise to the wellhead will accumulate in the gas space provided above the waste water inlet nozzle. The gases which collect in the gas space may be vented without further treatment because the hydrogen sulfide will have been absorbed into the waste water deep in the well bore at the point of gas injection.

The carbon dioxide gas that dissolves into the waste water (brine) will impart acidity to the waste water by the ionization of the carbonic acid that is formed by the reaction of the carbon dioxide gas and water. Lowering the pH of the waste water will be beneficial, especially where the brine is produced from reservoirs containing carbonate mineralization. The acidic condition of the waste water will tend to dissolve any carbonate precipitates suspended in the waste water that is injected into the disposal well. Lowering the pH of the waste water will also retard the kinetics of the polymerization reaction of the monomeric silica crystals suspended in the waste water (brine).

The primary object of the present invention is to provide a system and method for safely disposing of noncondensable gases, including hydrogen sulfide gas, derived from geothermal fluids wherein the noncondensable gases are injected into a well bore along a path separate from the path in which waste water (spent brine) is injected into the well, with the length of the path along which the noncondensable gases flow being selected to correspond to the depth in the well which provides a static head pressure equal to the gas partial pressure required to dissolve the noncondensable gases into the waste water so that there will be dissolution of the noncondensable gases into the waste water so as to prevent the venting of such noncondensable gases to the atmosphere.

Other objects of this invention will become apparent as the following specification progresses, reference being made to the accompanying drawing for a schematic illustration of the system of the present invention.

The system of the present invention is broadly denoted by the numeral 10 and includes a waste water injection well 12 having a well casing 14 which extends above and below ground level 16. The portion of the well casing extending below ground level 16 extends into a water injection zone broadly denoted by the numeral 18. The well casing extends above ground level to a location denoted by the numeral 20. A wellhead tee 22 having a shut-off valve 24 is at the upper end of the wellhead casing. The tee has a valve 26 which couples a fluid line 28 having a check valve 29 to wellhead tee 22. Line 28 has a gas compressor 30 driven by a motor 32 or other drive means for compressing noncondensable gases flowing along line 34 to compressor 30 to a relatively high pressure, such as 50 psi or higher.

The lower end of tee 22 is coupled by a valve 36 to the upper end of a tubing hanger 38 secured to the rest of the well casing 14. Another tee 39 is secured intermediate the ends of casing 14 and has a valve 40 coupled to a fluid inlet line 42 having a check valve 43 and whose upstream end is coupled to a brine injection pump 44 to which an inlet line 46 is coupled. Waste water (spent brine) is directed into pump 44 which pumps the waste water into the wellhead casing past valve 40 at a lower pressure, such as a pressure of at least 50 psi or higher, depending on reservoir permeability.

From the lower end of well casing 14 is hung a slotted liner 47 with a plurality of slots 48 to allow the waste water to enter the injection zone 18. The part of the wellhead casing 14 below the casing end (shoe) in the injection zone 18 may be completed with a liner 47 or left "barefoot" (unlined). The well is drilled and completed with well casing 14 cemented in place. Thus, the well is completed in the conventional manner as practiced by the geothermal industry.

The well casing 14 is provided with an inner tubing 50 which is carried by tubing hanger 38 and extends downwardly from tubing hanger 38 to a region below ground level 16. Tubing 50 has a plurality of small holes 52 therethrough near its lower end to allow noncondensable gases flowing downwardly in tubing 50 to enter well casing 14 and to be mixed with waste water flowing downwardly in the wellhead casing to injection zone 18. The minimum length of tubing 50 below ground level 16 is equal to the depth in the well which provides a static head pressure equal to the gas partial pressure required to dissolve certain noncondensable gases into the waste water. The required gas partial pressure is determined from Henry's Law.

The noncondensable gases will contain carbon dioxide, hydrogen sulfide and ammonia. Other gases may be present, such as methane, nitrogen, hydrogen and argon. The latter four gases have a lower solubility than carbon dioxide, hydrogen sulfide and ammonia; however, if methane, nitrogen, hydrogen and argon are present in significant amounts in the noncondensable gases, the total pressure required to dissolve all of the gas constituents may be very high. In such a case, the length of tubing 50 may be set at a value corresponding to the depth in the well which provides a static head pressure equal to the gas partial pressure required to dissolve the more soluble constituents of the gas mixture into the waste water. Such pressure is established by the operation of compressor 30 coupled with inlet line 28 to tee 22.

In operation, waste water (brine) is pumped to the wellhead casing 14 along line 42 by pump 44. The waste water flows down the annulus between the well casing 14 and tubing 50. The waste water flows downwardly to the portion of the casing in which slots 48 are located and flows through the slots into the water injection zone 18. The waste water typically flows down the well bore casing at a rate of 4 to 8 feet per second.

During this time, the noncondensable gases along line 34 are compressed by compressor 30 to a relatively high pressure, greater than 50 psi, and the high pressure gases enter tee 22 and then enter the tubing 50 for downward flow through the tubing to holes 52 at which depth the gases enter the waste water stream in the form of small gas bubbles. In flowing downwardly through tubing 50, the noncondensable gases displace the water inside the tubing down to the depth of holes 52.

The length of tubing 50 is such that carbon dioxide, hydrogen sulfide and ammonia are dissolved in the waste water. Other gases, such as methane, nitrogen, hydrogen and argon, will, in part, be swept down with the waste water flowing down casing 14. However, these gases, if undissolved, will be in the form of bubbles that do manage to rise to the top of casing 14 and enter a gas cap chamber 54 immediately below tubing hanger 38. This gas space is provided to collect the gas and not to interfere with entering brine flow from line 42. The gases can be vented through a valve 56 to the atmosphere along a line 58. If desired, a pressure vessel 66 separate from casing 14 and in fluid communication therewith can be used as a gas collection chamber, such pressure vessel being connected by piping to the casing at a location below the tubing hanger.

A gas-liquid interface level controller 60 is coupled to the well casing or pressure vessel at two locations, namely below and above the water level 62 of the waste water in casing 14 or vessel 66. Controller 60 maintains the gas level above the brine inlet line 42 to prevent gas entrapment in the brine and "gas binding." Level controller 60 transmits signals along line 64 to the control valve 65 in the outlet line 58 for venting gases to the atmosphere. The gas vented to the atmosphere along line 58 is, of course, free of hydrogen sulfide because the hydrogen sulfide gas will have been dissolved in the waste water by virtue of the injection of the hydrogen sulfide gas through holes 52 in tubing 50 and into the downwardly flowing waste water flowing toward and into injection zone 18.

By the use of system 10, noncondensable gases are returned to a reservoir formation in the same chemical form in which they were produced. Such gases are not required to undergo sophisticated chemical processing which creates waste products requiring special handling and disposal. The waste water flowing through casing 14 needs only to be pumped to a pressure sufficient to inject the waste water into injection zone 18. In many cases, it is only necessary to deliver the waste water to wellhead casing 14 because the static head of the waste water is sufficient to dispose of it down the well bore casing 14.

By injecting the noncondensable gases downwardly through tubing 50 to a depth of hydraulic head pressure corresponding to the partial pressure required to dissolve the gases into the solution, the overall injection pressure of system 10 will be stable. The small gas bubbles which result after the gases are injected through holes 52 of tubing 50 will facilitate the dissolving of the gases into the waste water. The gases which collect in gas space 54 may be vented to the atmosphere without further treatment because the hydrogen sulfide gas will have been absorbed into the waste water deep in well bore casing 14 below the point of gas injection into the waste water, namely at the location of holes 52.

I claim:

1. A system for disposing of gases from a geothermal well which are noncondensable at ambient conditions comrising:

a wellhead casing having a fluid inlet and adapted to be placed into the ground to provide a first fluid path for directing waste water from ground level to a water injection zone below ground level;

means coupled with the casing for providing a second fluid path extending longitudinally of the first path, said second path-forming means having inlet means for receiving noncondensable gases for flow along said second path, the length of the second path being at least of a value corresponding to the depth in the wellhead casing which provides a static waste water head pressure equal to the gas partial pressure required to dissolve at least a portion of the noncondensable gases into the waste water; and means for pressurizing the noncondensable gases before they flow along said second path.

2. A system as set forth in claim 1, wherein said second path-forming means comprises a tubing.

3. A system as set forth in claim 2, wherein said tubing is within the wellhead casing.

4. A system as set forth in claim 2, wherein the tubing has a plurality of holes therethrough near the lower end thereof.

5. A system as set forth in claim 1, wherein said wellhead casing extends upwardly above ground level, said second path-forming means comprising a tubing extending upwardly from ground level within the wellhead casing.

6. A system as set forth in claim 5, wherein the casing has means for venting to the atmosphere the accumulated gases which have accumulated in the wellhead casing near the upper end thereof.

7. A system as set forth in claim 6, wherein said casing has a gas collection chamber near the upper end thereof, said venting means being coupled to said chamber.

8. A system as set forth in claim 6, wherein said venting means includes a pressure vessel exteriorly of and in fluid communication with the casing near the upper end thereof.

9. A system as set forth in claim 1, wherein said pressurizing means includes a compressor for compressing the noncondensable gases to a value in the range of at least 50 psi.

10. A system as set forth in claim 1, wherein is included pump means for increasing the fluid pressure of the waste water before the waste water enters the casing.

11. A system as set forth in claim 10, wherein the pump operates to increase the fluid pressure of the waste water to a value of at least 50 psi.

12. A system as set forth in claim 1, wherein said noncondensable gases include hydrogen sulfide.

13. A system as set forth in claim 1, wherein said noncondensable gases comprise carbon dioxide, hydrogen sulfide and ammonia, the length of the second path being of a value corresponding to the depth in the wellhead casing below ground level which provides a static waste water head pressure equal to the sum of the partial pressures of carbon dioxide, hydrogen sulfide and ammonia.

14. A process of disposing of gases in a geothermal well which are noncondensable at ambient conditions comprising:

directing a flow of waste water into a well casing and downwardly along a first path toward and into an injection zone below ground level; and directing noncondensable gases along a second path extending longitudinally of the first path and terminating at a location intermediate the ends of the first path with the length of the second path being at least of a value corresponding to the depth in the well which provides a static waste water head pressure equal to the gas partial pressure required to dissolve at least a portion of the noncondensable gases in the waste water.

15. A process as set forth in claim 14, wherein the second path is within the first path.

16. A process as set forth in claim 14, wherein the second path is within and surrounded by the first path, the second path having a plurality of orifices near the lower end thereof for the transfer of noncondensable gases to the first path.

17. A process as set forth in claim 14, wherein is included the step of pressurizing the noncondensable gases before the latter enter the second path.

18. A process as set forth in claim 14, wherein is included the step of pumping the waste water into the first path for flow downward to said injection zone.

19. A process as set forth in claim 14, wherein is included the step of permitting certain of the noncondensable gases to flow upwardly to a chamber, and venting the gas in the chamber to the atmosphere.

20. A process as set forth in claim 14, wherein the noncondensable gases include hydrogen sulfide.

21. A process as set forth in claim 14, wherein the noncondensable gases include carbon dioxide, hydrogen sulfide and ammonia, the length of the second path being of a value equal to at least the depth in the well which provides a static waste water head pressure equal to the gas partial pressures required to dissolve carbon dioxide, hydrogen sulfide and ammonia into the waste water.

22. A process as set forth in claim 21, wherein said noncondensable gases include carbon dioxide and hydrogen sulfide and are pressurized to a partial pressure value sufficient to dissolve substantially all of the hydrogen sulfide but only a portion of the carbon dioxide.

* * * * *